US006783402B2

(12) United States Patent
Chen

(10) Patent No.: US 6,783,402 B2
(45) Date of Patent: Aug. 31, 2004

(54) FAST ELECTRIC CONNECTOR PLUG SATISFYING CATEGORY 6 STANDARD

(75) Inventor: Michael Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 10/216,215

(22) Filed: Aug. 12, 2002

(65) Prior Publication Data

US 2004/0029450 A1 Feb. 12, 2004

(51) Int. Cl.[7] ..... H01R 24/00
(52) U.S. Cl. ..... 439/676; 439/344
(58) Field of Search ..... 439/418, 941, 439/676, 344, 465

(56) References Cited

U.S. PATENT DOCUMENTS 5,571,035 A * 11/1996 Ferrill ..... 439/894
6,007,368 A * 12/1999 Lorenz et al. ..... 439/418
6,083,052 A * 7/2000 Adams et al. ..... 439/676
6,099,345 A * 8/2000 Milner et al. ..... 439/460
6,375,491 B1 * 4/2002 Durand et al. ..... 439/418
6,439,920 B1 * 8/2002 Chen ..... 439/418

* cited by examiner

*Primary Examiner*—Khiem Nguyen
(74) *Attorney, Agent, or Firm*—Birch, Stewart, Kolasch & Birch, LLP

(57) ABSTRACT

A fast electric connector plug has the category 6 (CAT-6) standard. Through an insertion element installed inside an electric connector plug, the four twisted pairs of a CAT-6 cable are configured in four directions of the same central point. At the same time, the position of each twisted pair is kept non-twisted and parallel before it reaches contacts of the plug. The wire positions can be controlled to be close to one another, producing compensation effects to achieve more reliable fast data transmissions.

14 Claims, 14 Drawing Sheets

FAST ELECTRIC CONNECTOR PLUG SATISFYING CATEGORY 6 STANDARD

BACKGROUND OF THE INVENTION

1. Field of Invention

The invention relates to an electric connector plug and, in particular, to a fast electric connector plug satisfying the category 6 standard.

2. Related Art

In response to future fast network application in the Ethernet, the U.S. Telecommunications industry Associations (TIA) develops an enhanced CAT-6 standard on top of the CAT-5 100 MHz wiring system. The CAT-6 standard is expanded from 100 MHz of the CAT-5 standard to 200 MHz. Its capacity is also higher than that of CAT-5 by 25%. Therefore, the test frequency for CAT-6 cables may even reach 250 MHz. The biggest difference between CAT-6 and CAT-5 is the improvement in cross-talks and return losses. For new generation full duplex fast network applications, fewer return losses are very important. The cross-talk is a key factor for the best bandwidth. Although 100 Mbps is still the mainstream in current network setups, the CAT-6 standard will be more suitable for the future needs.

The above-mentioned standard does not only apply to fast communication cables. To maintain the same fast transmission speed in fast communication network systems, related peripheral devices of fast communication cables, particularly the electric connectors (such as RJ-45 plugs and jacks), have to have corresponding designs. The connector commonly used in fast communication networks is the RJ-45 connector (including plugs and jacks). The normal RJ-45 connector is 8P8C, where 8P means 8 positions and 8C means 8 gold-plated contacts. In practice, only two pairs are really used and the other two pairs are saved for telephone lines or fax machines. EIA/TIA defines two kinds of connectors, namely EIA/TIA-568A and EIA/TIA-568B. The EIA/TIA-568A, however, has been abandoned; only EIA/TIA-568B is still in use. Its pins, from 1 to 8, are covered by the following colors: white-orange, orange, white-green, blue, white-blue, green, white-brown, and brown, respectively.

Most of the prior art emphasize on the structure of jacks, in order to satisfy the above-mentioned standards. But they all have some problems. To solve these problems, the inventor proposed a solution, disclosed in the pending U.S. patent application Ser. No. 09/954,054. In these applications, a configuration was proposed to keep any twisted pair in the twist relation before it touches contacts of the plug. Therefore, the configuration can achieve more reliable fast data transmissions. However, the guide channels of the applications do not constrain the twisted pairs therein. Therefore, the positions of the wires after the guide channels are hard to control. In other words, the two wires in each twisted pair cannot be controlled to align with the corresponding contacts. This drawback thus requires extra procedures for calibration.

SUMMARY OF THE INVENTION

An objective of the invention is to improve the structure of conventional plugs and provide a fast transmission electric connector plug satisfying the category 6 (CAT-6) standard. The invention uses an insertion element that can be put into an electric connector plug. This insertion element has several guide channels, which are distributed in four directions relative to the same central point. Each twisted pair of the fast communication cable is connected to the contacts at the front end of the plug under the guidance of the corresponding guide channel. The cross section of each guide channel is a long hole for a twisted pair to pass through in parallel. In this manner, the wire positions can be readily controlled. Besides easy alignment with the contacts, the compensation between the wires can be made to satisfy the CAT-6 standard for fast communications.

Another objective of the invention is to provide an electric connector plug with better assembly quality.

To achieve the above objectives, the insertion element of the invention has two parts, including a carrier and a cover. The carrier and the cover tightly hold the fast communication cable before each twisted pair and the insertion element are installed inside the plug. This can prevent the end of any cable from being displaced due to friction in the assembly process, resulting in incorrect connections with the contacts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1:
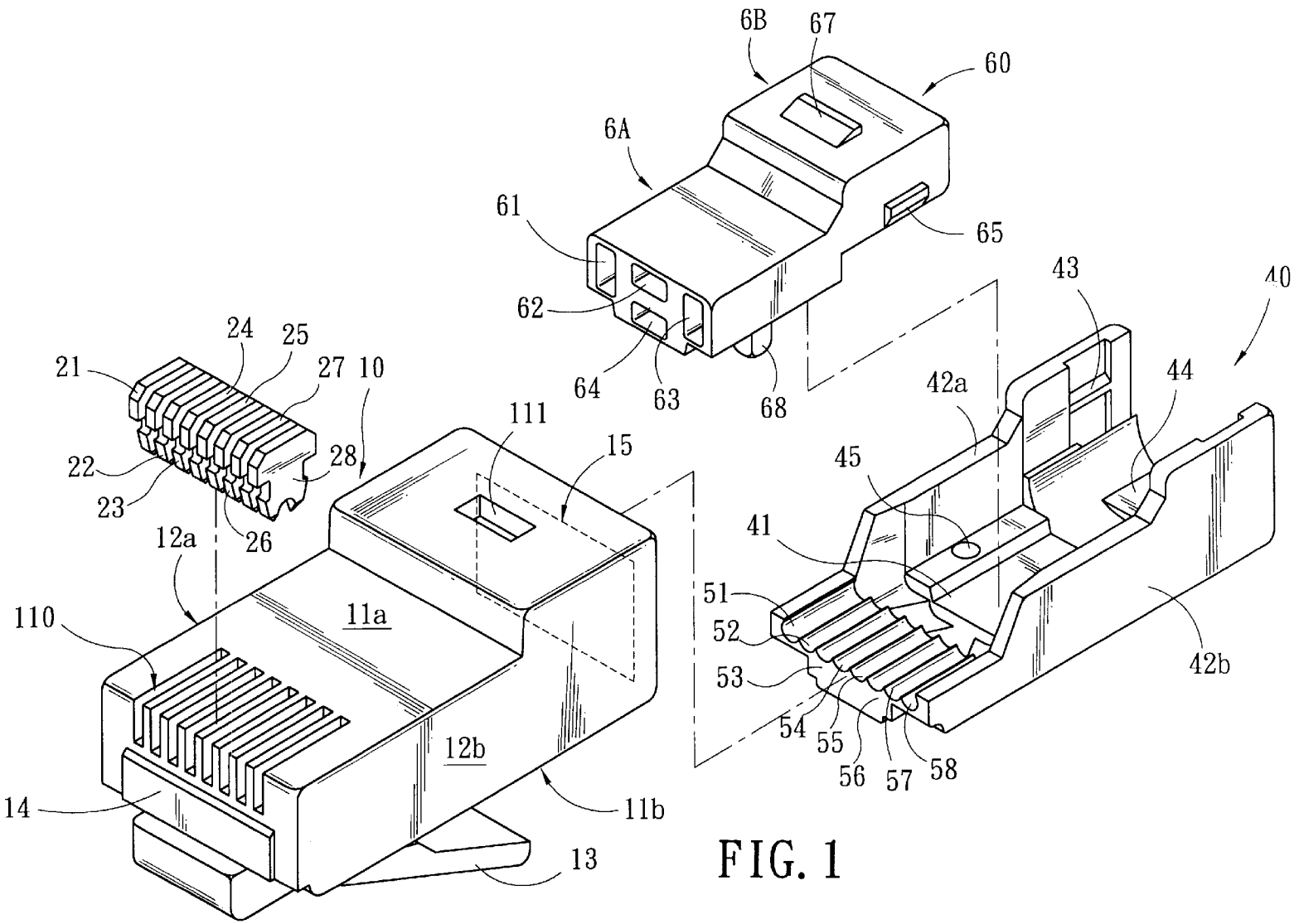
FIG. 1 is an exploded view of the structure of the invention.
Figure 4:
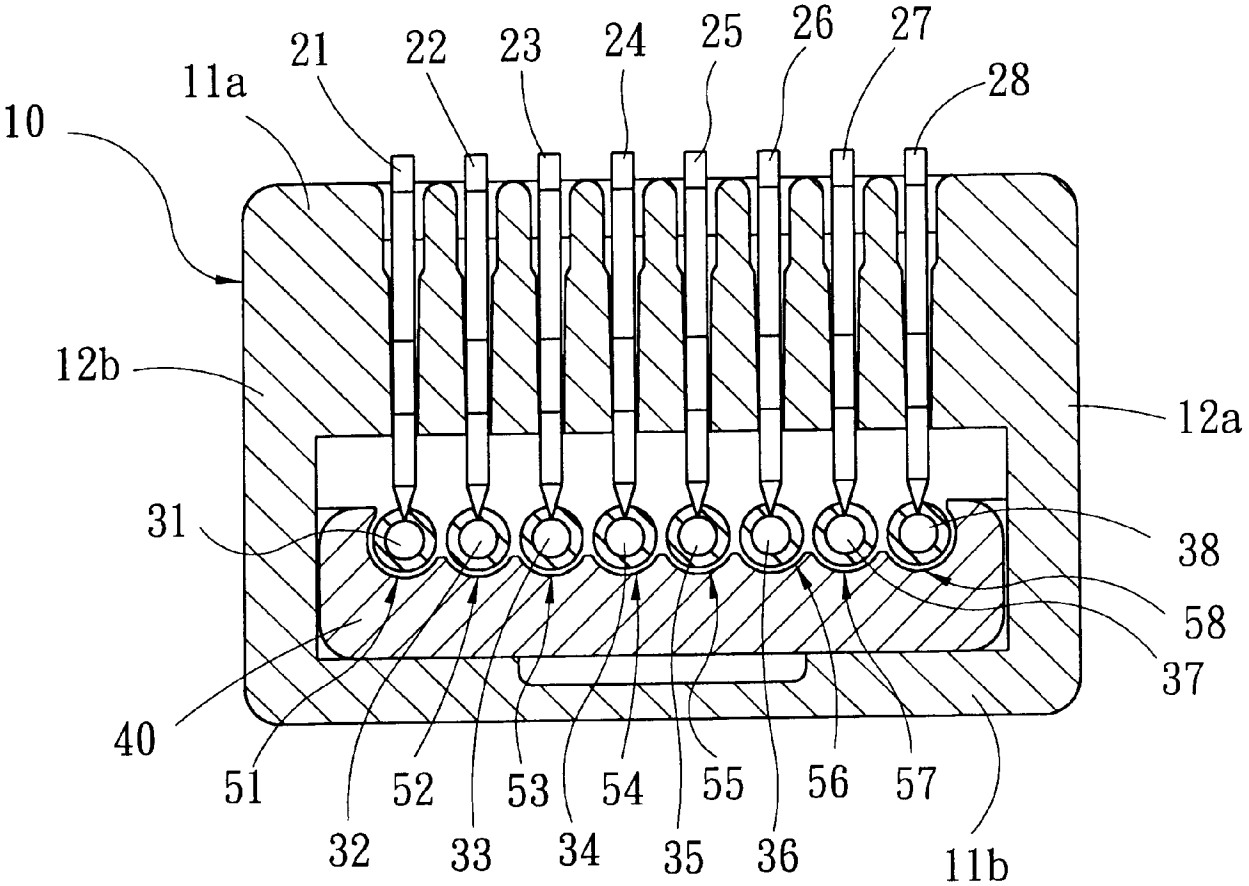
FIG. 4 is a cross-sectional view of FIG. 3 at the IV—IV position, showing the contact relation between the metal electrodes and the twisted pairs.

Please refer to FIG. 1. The disclosed electric connector plug has a plug shell 10 and an insertion element. The plug shell 10 has the size of an RJ-45 electric connector plug. It is a hollow element with a upper wall 11*a*, a lower wall 11*b*, a left wall 12*a*, a right wall 12*b*, and an elastic chip 13 located at the bottom of the lower wall 11*b* and extending downwards. The elastic chip 13 is used to hold and connect with an electric connector jack (not shown). The front end in the insertion direction toward the electric connectorjack is a closed front wall 14. The other end is an opening 15 to the exterior. The front end of the plug shell 10 has eight metal electrodes 21~28. The metal electrodes 21~28 are inserted from the insertion holes 110 at the front end of the upper wall 11*a* downward into the plug shell 10. They are connected with the twisted pairs 31~38 of the fast communication cable 30 through the sharp front ends of the metal electrode 21~28. The metal electrodes 21~28 have the same length (see FIG. 4).

The insertion element is inserted into the plug shell 10 through the opening 15 along the same installation direction of the plug shell 10. It has a carrier 40 and a cover 60. The carrier 40 is a narrow and long element. It has a bottom part 41, a left wall 42*a*, and a right wall 42*b*. Several wire slots 51~58 at the bottom part 41 near the front end of the plug shell 10 extend forward. These wire slots 51~58 are underneath eight metal electrodes 21~28 for supporting different twisted pairs 31~38. The front end of each metal electrode 21~28 can prick through the insulating coat of the corresponding twisted pair 31~38, resulting in electrical communications with the wires.

Figure 2:
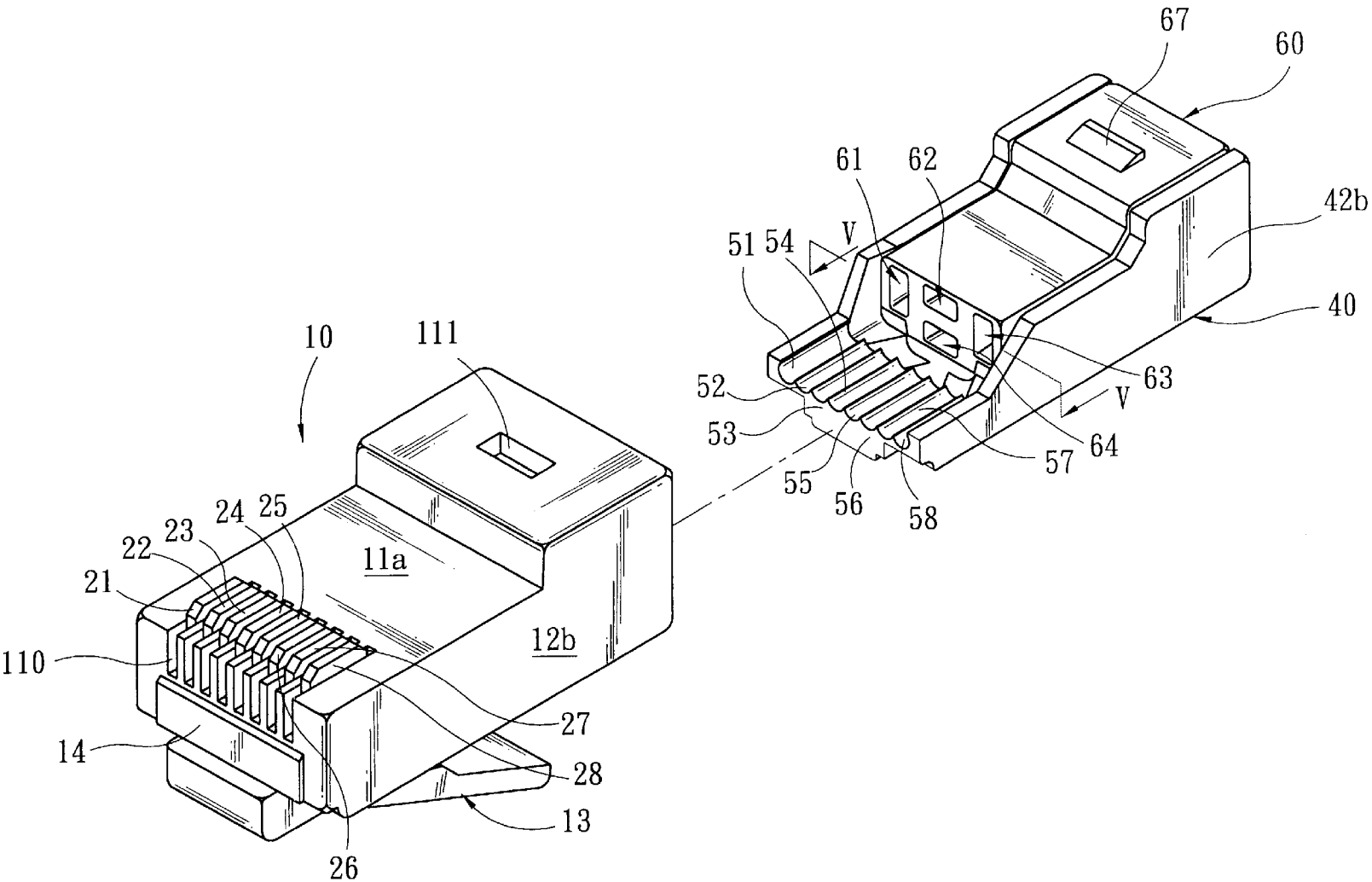
FIG. 2 demonstrates the structure of the invention, showing how the carrier and the cover are combined and the plugging direction of the combined insertion element into the plug shell.
Figure 3:
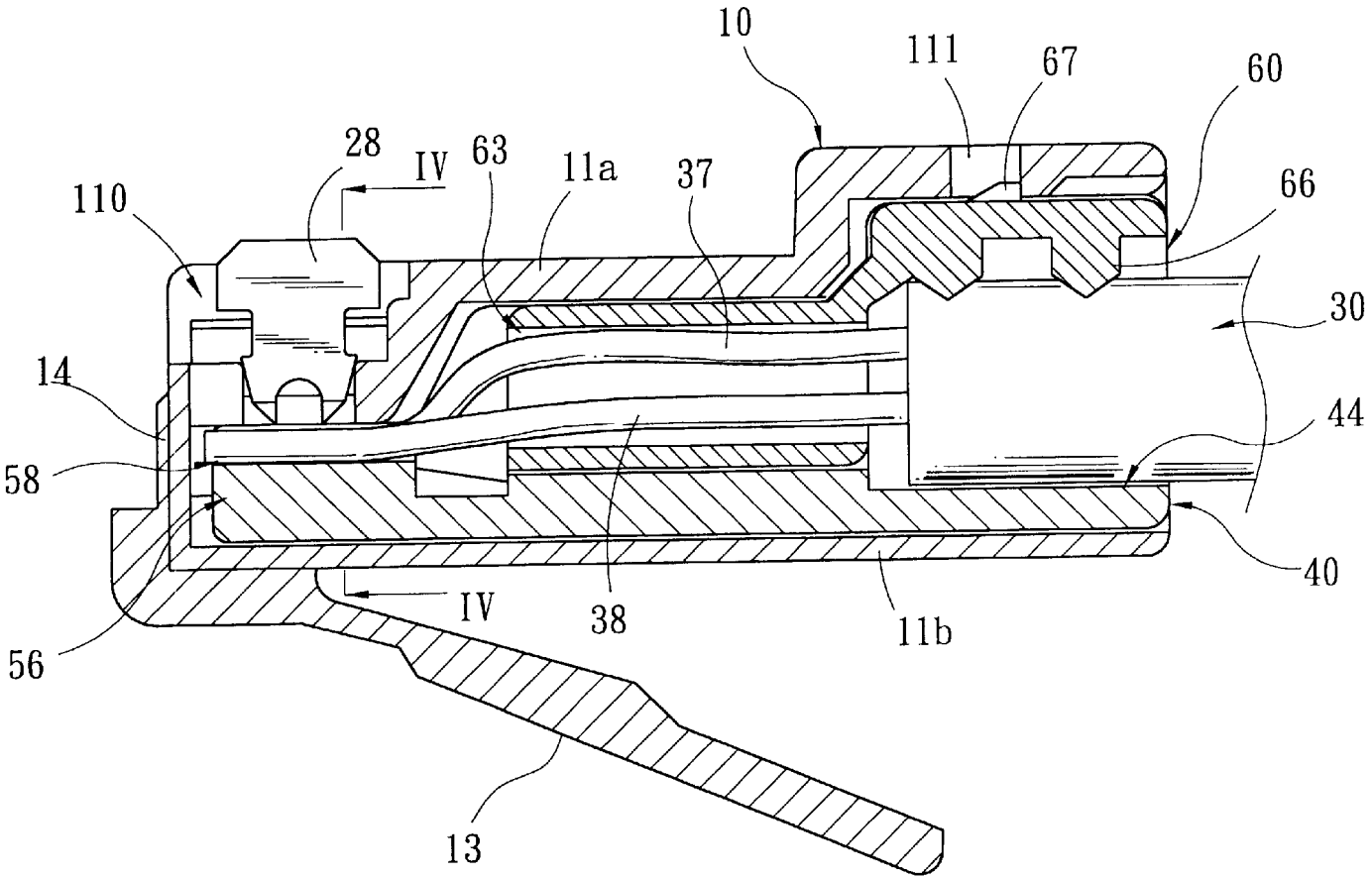
FIG. 3 is a cross-sectional view of the disclosed structure, showing the cross section of the electric connector plug and the assembly of the fast communication cable and the insertion element.

The cover 60 is also a narrow and long element. It can be installed in the space enclosed by the bottom part 41, the left wall 42*a*, and the right wall 42*b* of the carrier 40 (see FIG. 2). The cover 60 can be divided into a front section 6A and a rear section 6B along its axial direction. Four guide channels 61~64 penetrate through the front section 6A for guiding the four twisted pairs 31&32, 33&36, 34&35, 37&38 (Pairs 1~4) of the fast communication cable 30. The guide channels 61~64 are long holes (with a rectangular or circular cross section). The four twisted pairs 31&32, 33&36, 34&35, 37&38 (Pairs 1~4) go through the guide channels 61~64 in a parallel and non-twisted way. The rear section 6B has several connecting elements 65 (such as hooks) installed on the two walls 42*a*, 42*b* for connecting with the connecting parts 43 (such as hook holes) formed on the left wall 42*a* and the right wall 42*b* of the carrier 40, thereby combining the cover 60 and the carrier 40. The cover is further installed with several protruding wire holding saws 66 on the surface facing the carrier 40. A wire holding surface 44 is formed at the corresponding position on the bottom part 41 of the carrier 40. After the cover 60 and the carrier 40 are combined together, the fast communication cable 30 is tightly held between the cover 60 and the carrier 40 (see FIG. 3).

Figure 5:
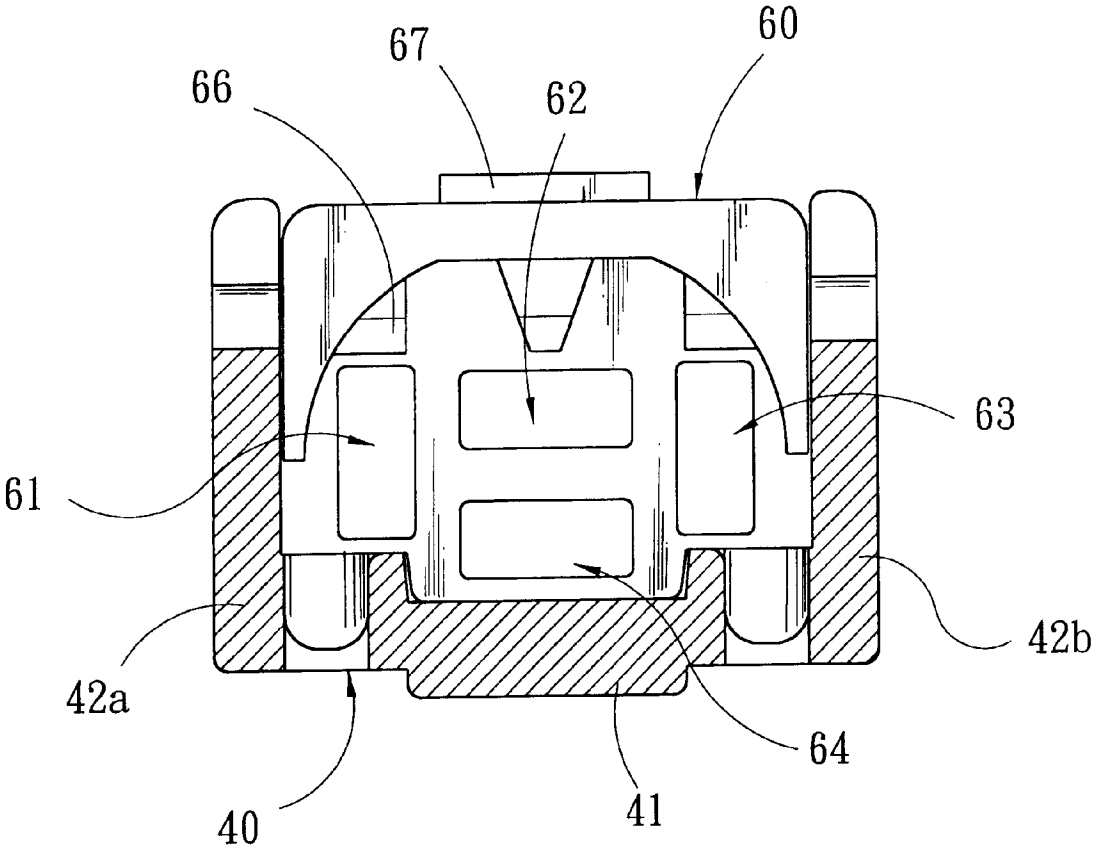
FIG. 5 is a cross-sectional view of FIG. 2 at the V—V position, showing the positions of the guide channels after the cover and the carrier are combined together.
Figure 8:
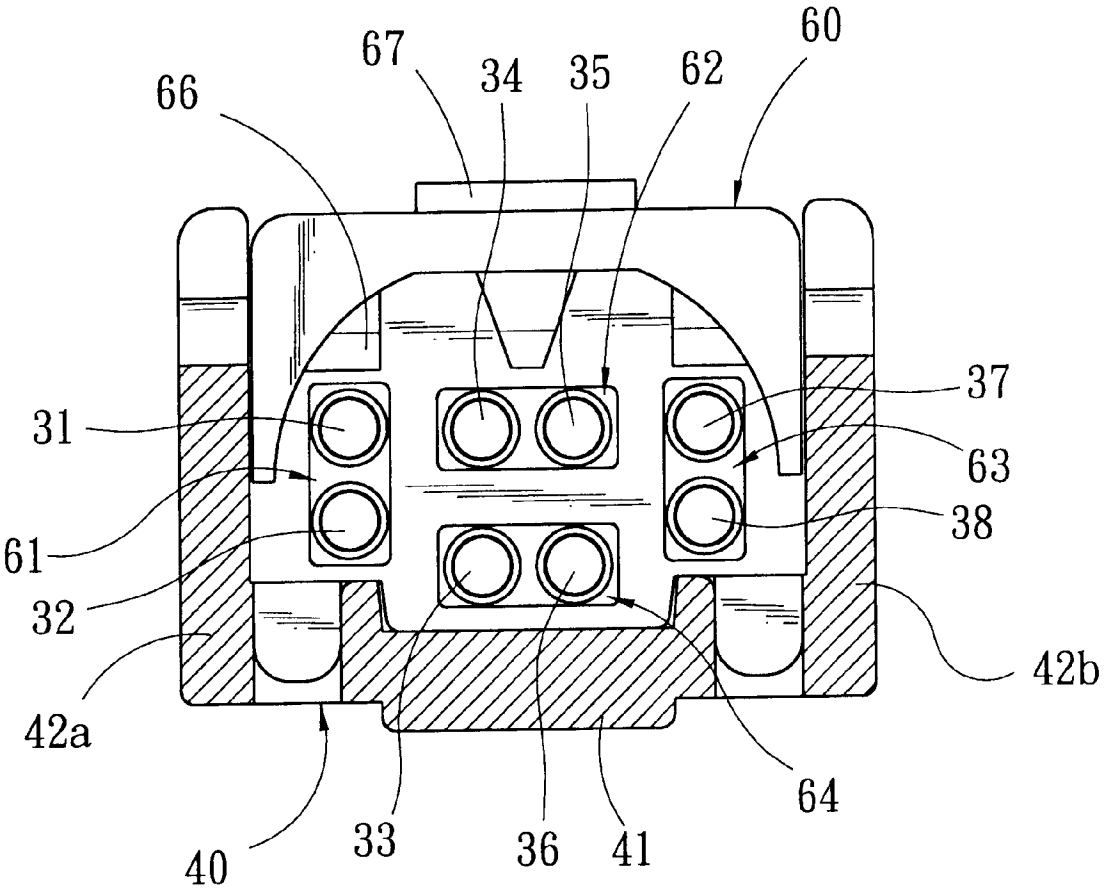
FIG. 8 is a cross-sectional view of FIG. 2 at the V—V position, showing the positions of each wire in the guide channels.
Figure 9:
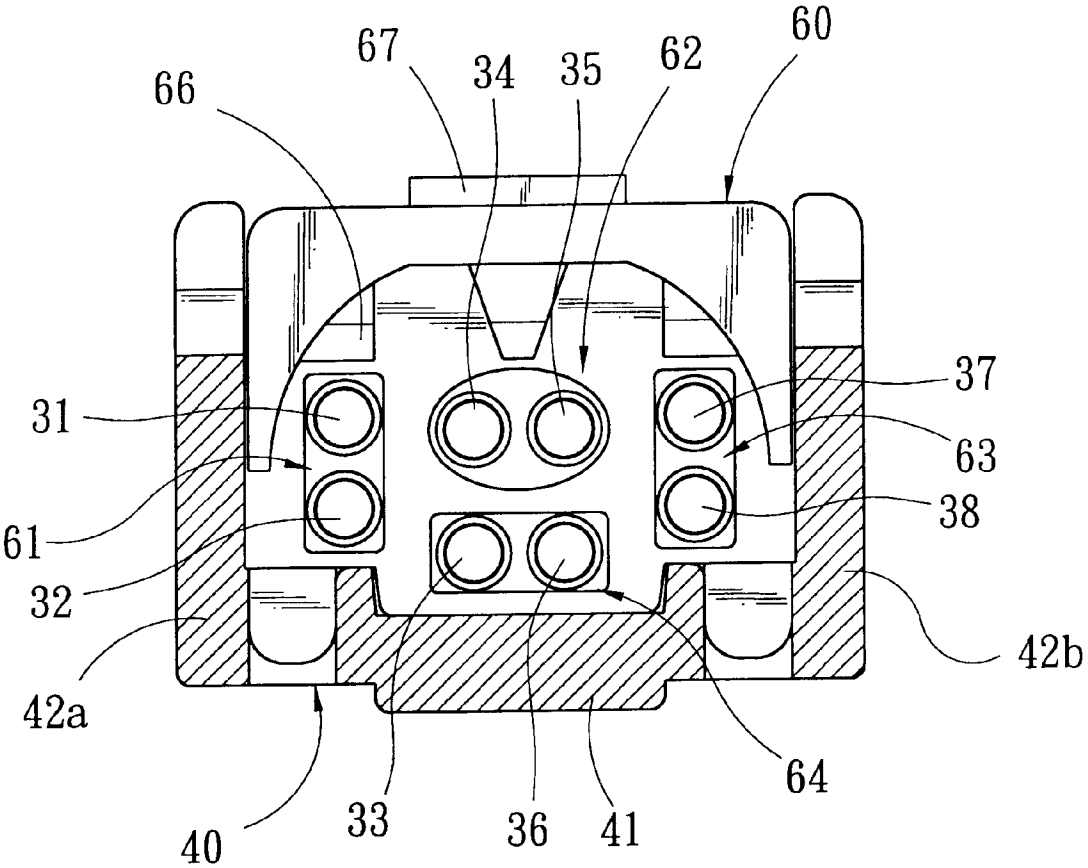
FIG. 9 is another embodiment of the guide channel configuration.
Figure 10:
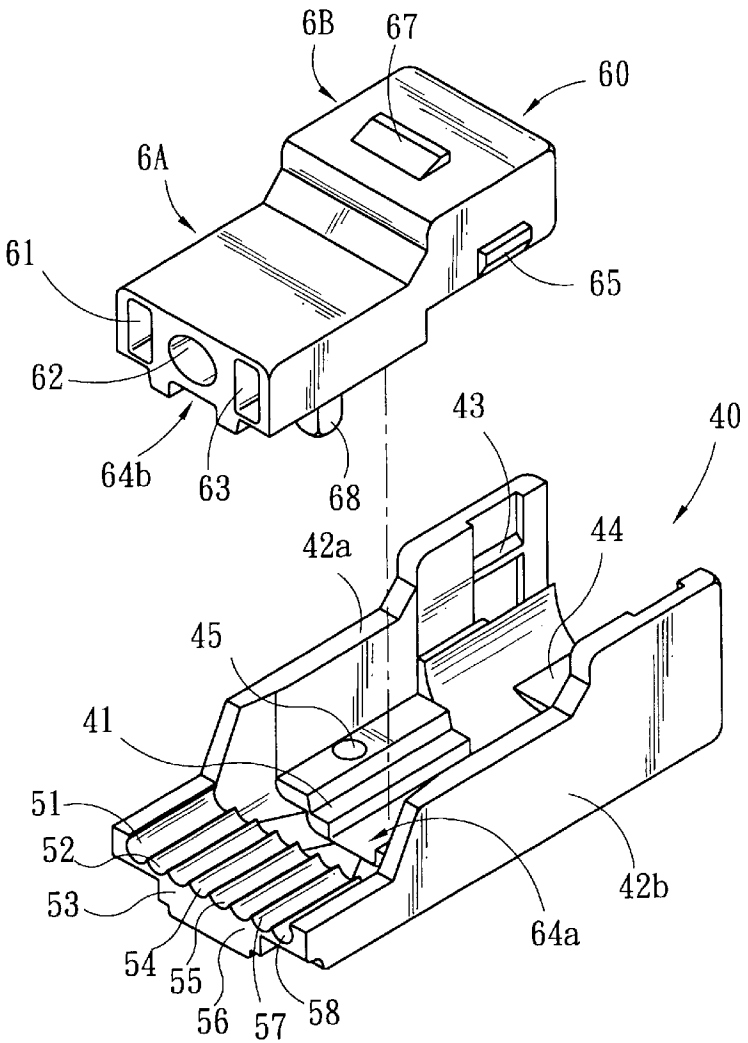
FIG. 10 is a schematic view of the disclosed guide slots.

In principle, the guide channels 61~64 are long holes and have to be formed in four directions around the same central point. As shown in FIG. 5, the guide channels 61, 63 are on the left and right sides, whereas the guide channels 62, 64 are on the upper and lower sides. The four twisted pairs 31~38 then go through the guide channels 61~64 in parallel. Since the twisted pairs 31~38 in this section are parallel with each other and non-twisted, the wire positions after the guide channels 61~64 can be properly controlled to get compensations for the TT and TR effects. For example, as shown in FIG. 8, if the wire 34 is T (tip) and the wire 35 is R (ring) in the first twisted pair 34, 35 and the wire 31 is T and the wire 32 is R in the second twisted pair 31, 32, then one can make the wire 34 and the wire 32 get closer, producing the TR compensation effect. The first twisted pair 34, 35 is preferably configured above the third twisted pair 33, 36. On the other hand, the guide channels 61~63 are on the same level, but the guide channel 64 is at a different level (see FIG. 9). The guide channels 61~64 are still long holes for the twisted pairs 31~38 to go through in a parallel and non-twisted way. With reference to FIG. 10, the guide channel 64 can be also formed using a lower guide slot in the middle section of the bottom part 41 of the carrier and an upper guide slot 64*b* at the center of the bottom surface of the front section 6A of the cover 60.

Figure 6:
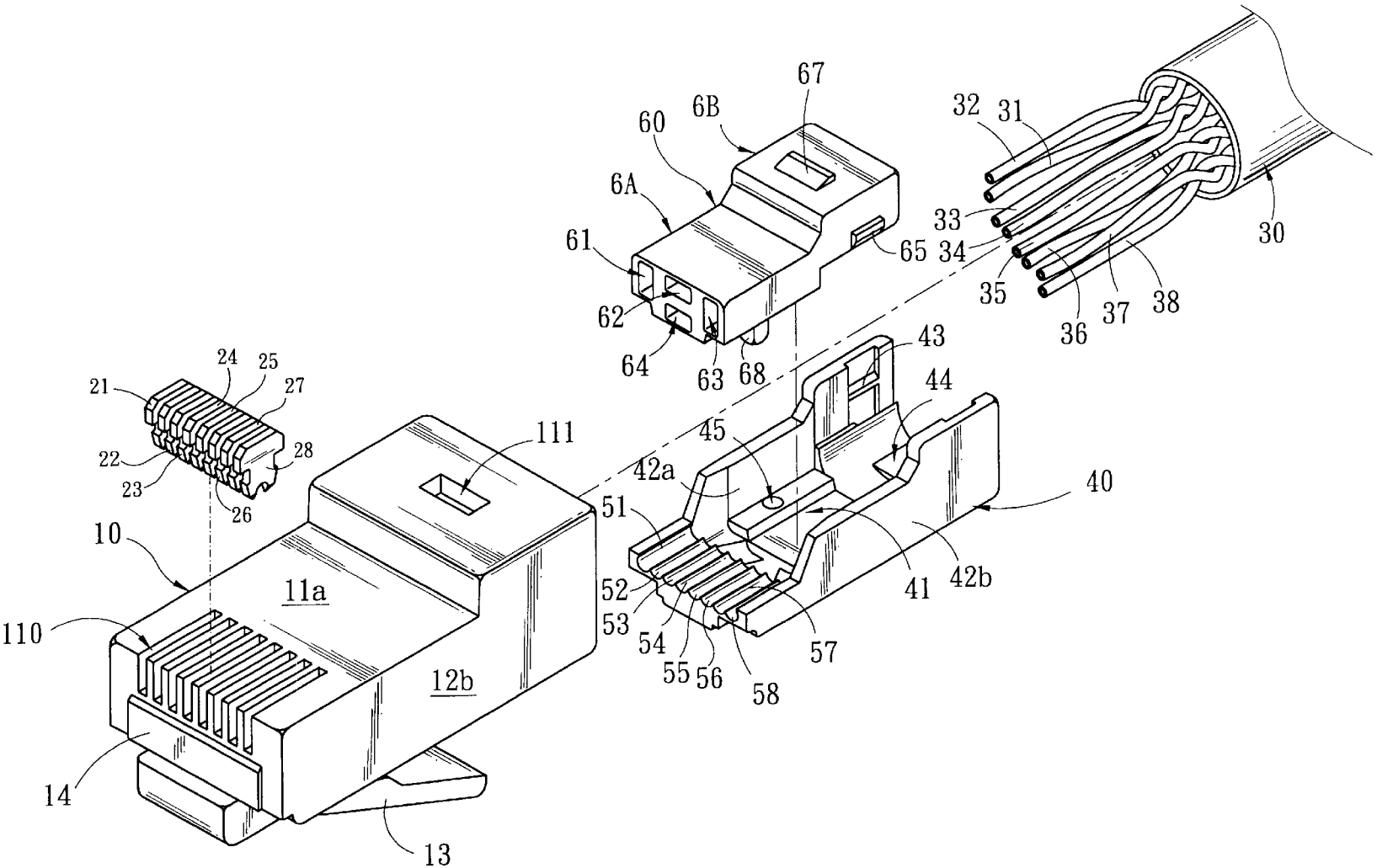
FIG. 6 is a schematic view showing how the fast communication cable and the insertion element are assembled.

With further reference to FIG. 6, when the electronic connector plug and the fast communication cable 30 are connected together, the cover layer of the fast communication cable 30 is first peeled. The four twisted pairs 31~38 (Pairs 1~4) inside the fast communication cable are taken out and the twisted wires are untangled. Afterwards, the four twisted pairs 31~38 are inserted in parallel through the guide channels 61~64 of the insertion element (see FIG. 3). As shown in the drawing, the first and third twisted pairs 33~36 are in parallel on the same horizontal plane and the second and fourth twisted pairs 31, 32, 37, 38 in parallel on the same vertical plane. The insulating cover layer of the fast communication cable 30 is moved as close as possible between the wire holding saws 66 of the cover 60 and the wire holding surface 44 of the carrier 40. The cover 60 and the carrier 40 are combined in such a way that the connecting elements 65 on both sides of the cover 60 and the connecting parts 43 of the carrier 40 are coupled. At the same time, the fact communication cable is tightly held between the cover 60 and the carrier 40.

Figure 7:
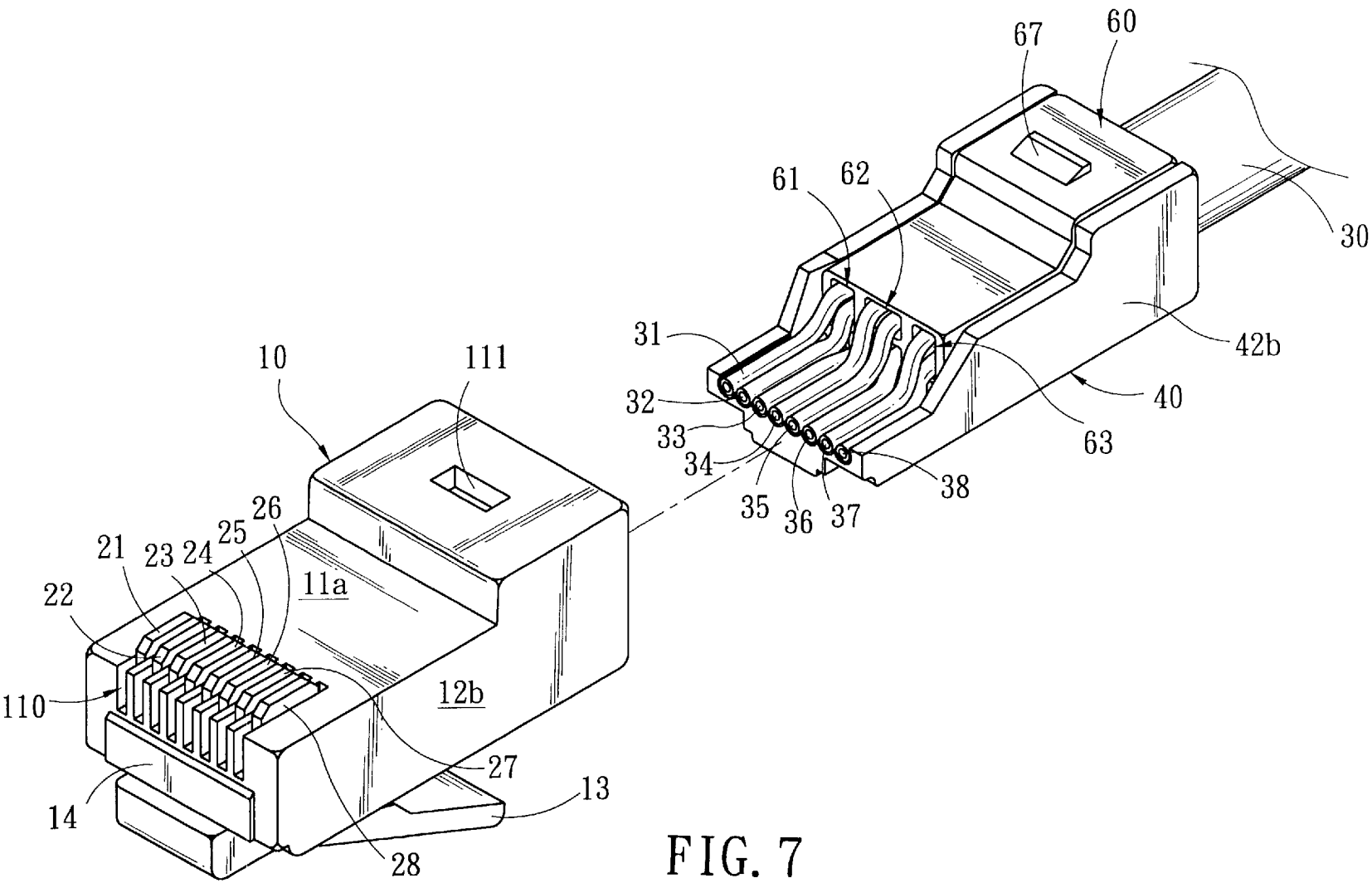
FIG. 7 is a schematic view showing the position of the wire of each twisted pair in the wire slots after the fast communication cable and the insertion element are combined.

It should be emphasized that one has to make sure that the four twisted pairs 31~38 have to extend out a certain length after penetrating through the four guide channels 61~64 before the cover 60 and the carrier 40 are combined. The ends of the four twisted pairs 31~38 extend into the wire slots 51~58. The insertion element holding the fast communication cable 30 is then inserted into the plug shell 10 from its rear opening 15 (see FIG. 7), until a hook 67 on the top surface of the rear section 6B of the cover 60 catches a hook hole 111 on the top wall 11*a* of the plug shell 10. Finally, the metal electrodes 21~28 are plugged into the insertion holes 110 at the front end of the plug shell 10. In this way, the sharp tips of the metal electrodes 21~28 can get into electrical contact with the twisted pairs 31~38 of the fast communication cable 30.

The wire slots 51~58 on the carrier 40 have a cross section with an upward opening. The width of the opening can be slightly smaller than the outer diameter of a single wire of the twisted pair 3~38. When the cover 60 and the carrier 40 are combined together, one can directly put the four twisted pairs 31~38 through along the axial direction of the wire slots 51~58. Alternatively, one can also straighten these twisted pairs 31~38 and push them downward through the narrow opening of the wire slots 51~58.

The wire holding surface 44 on the carrier 40 can be designed to have a wavy, saw-like or rough surface to enhance the holding effect to firmly clinch the fast communication cable. This design can also avoid the problem of incorrect connections between the twisted pairs 31~38 and the metal electrodes 51~58 during the process of inserting the insertion element into the plug shell 10. Another preferred design of the insertion element is to have a connecting pin 68 protruding from the bottom of the cover 60 downward. When the cover 60 and the carrier 40 are combined, the connecting pin 68 is plugged into a corresponding hole 45 on the carrier, increasing the reliability in the combination between the cover 60 and the carrier 40.

Figure 11:
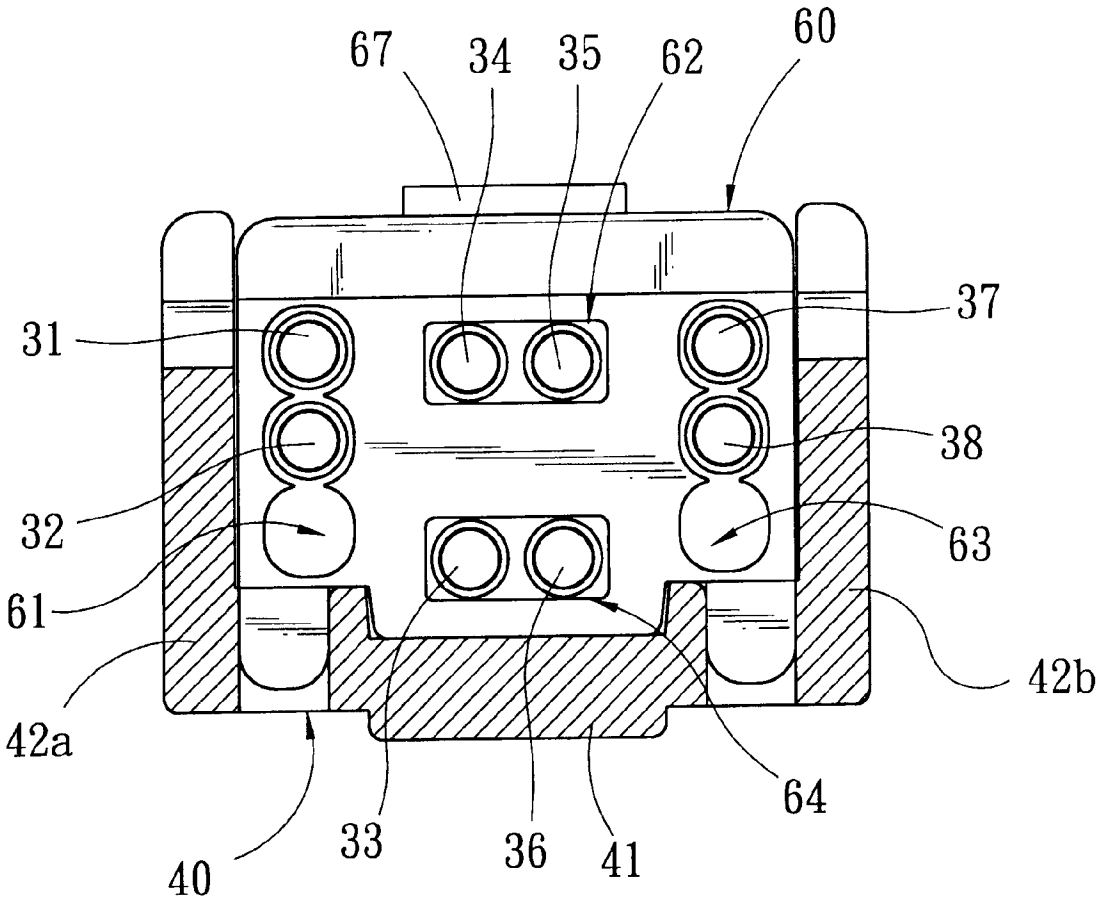
FIG. 11 is a schematic view of a single guide slot providing three wire positions.

On the other hand, some fast communication cables have different specifications for the communication connectors on both ends, such as 568A and 568B. On in some special cases, one may need to have jumps. To satisfy such needs and to further enhance the compensation effect, the two guide channels 61~64 can have at least three position holes. With reference to FIG. 11, the guide channels 61, 63 on the left and right sides have three position holes for the twisted pairs 31~38 to pass through. As shown in the drawing, three connected circular holes are formed to further limit the wire positions and their relative distances. For example, if one wants that the wire 31 of the second twisted pair is close to the wire 34 of the first twisted pair, but the wire 32 is not close to the wire 33 of the third twisted pair, then the wire 31 of the second twisted pair is put at the top position of the guide channel 61 and the wire 32 in the middle. This can achieve the TT or TR compensation effect. The same configuration also applies to jumps where wires are switched after jumps are made.

Figure 12:
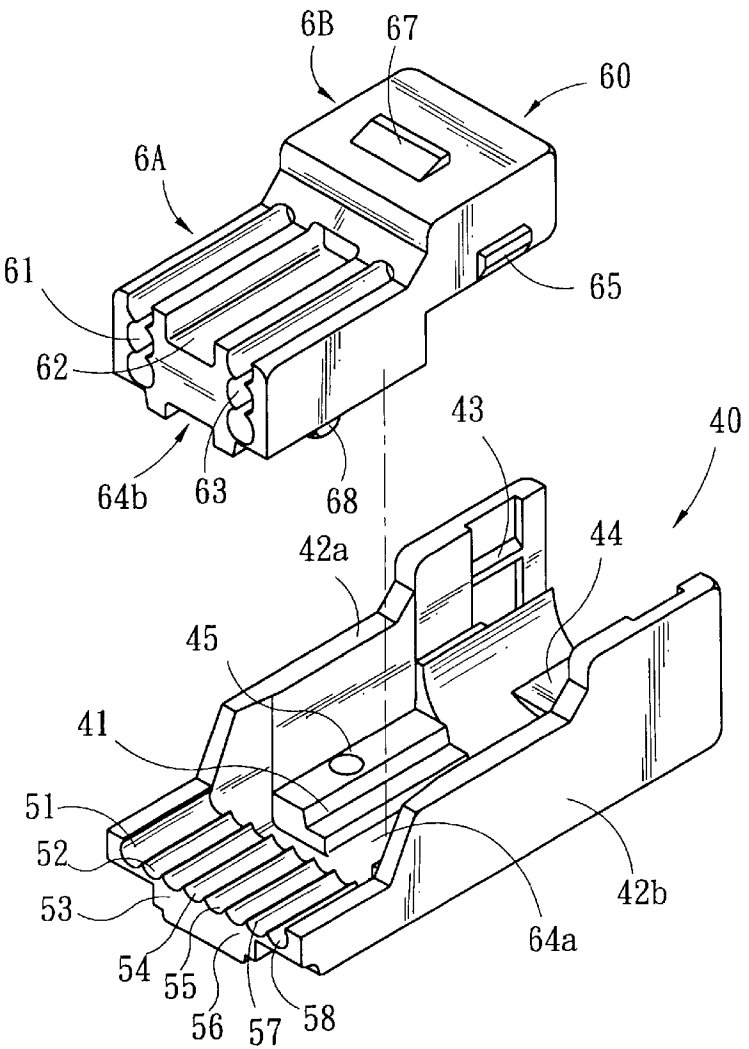
FIG. 12 is another embodiment of FIG. 11.
Figure 13:
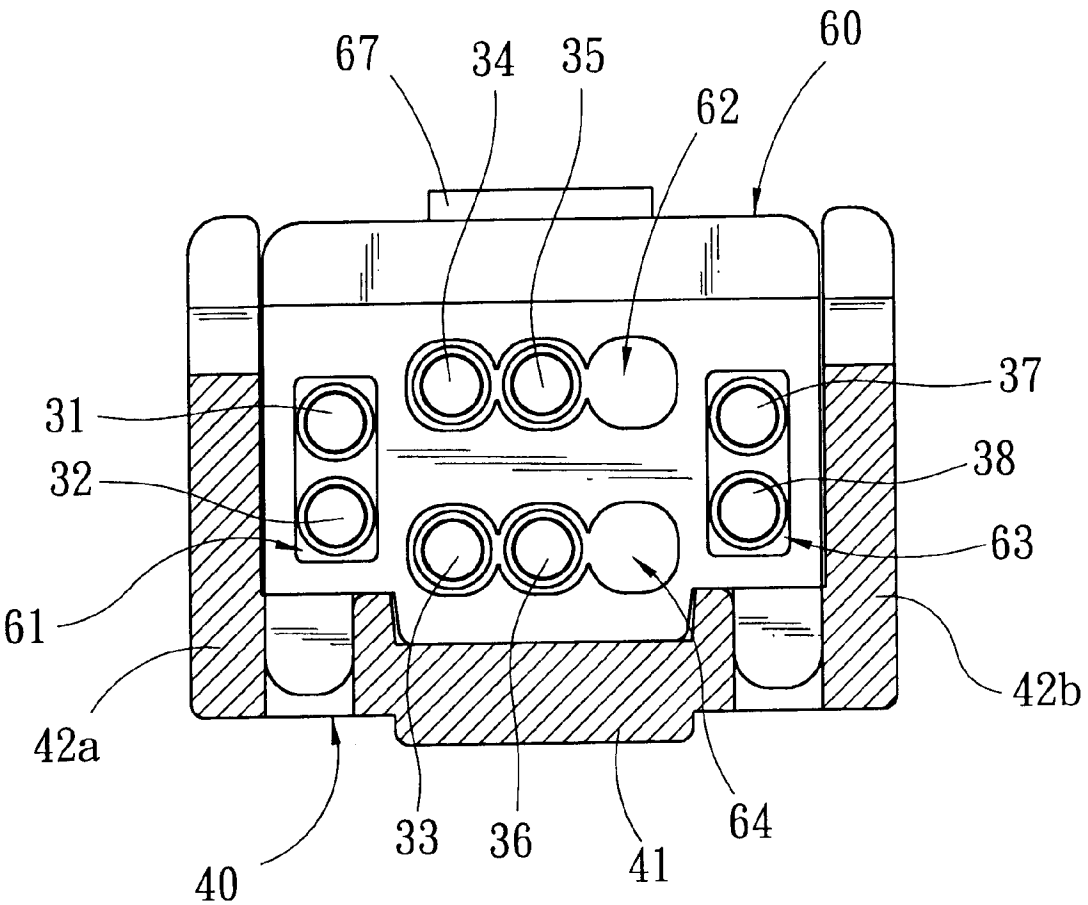
FIG. 13 is yet another embodiment of providing three wire positions within one guide slot.
Figure 14:
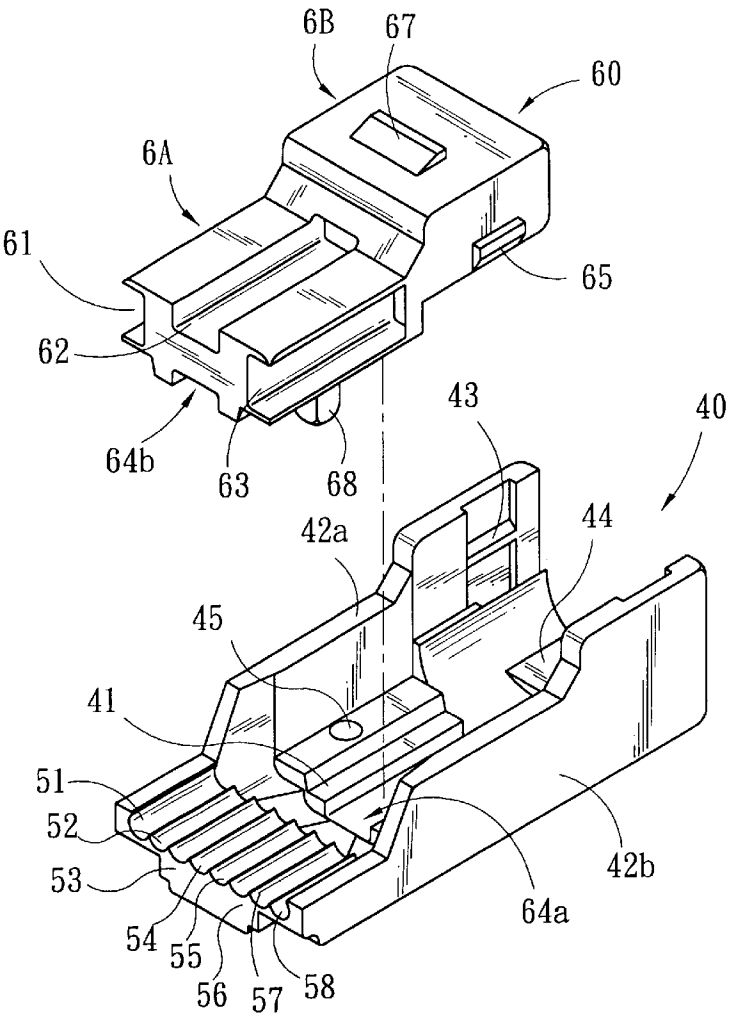
FIG. 14 is a schematic view of guide grooves.

This design of at least three positioning holes for the guide channels 61, 63 can also be applied to the other two guide channels 62, 64 (see FIG. 13). The above-mentioned guide channel structure is not limited to circular tubes shown in FIGS. 1, 11, and 13. They can be made to be like a guide groove (see FIGS. 12 and 14), or partly guide grooves and partly circular tubes. After being inserted into the plug shell 10, they are totally covered by the plug shell 10 or the carrier 40, with the same function of guiding the twisted pairs 31~38.

The embodiments in the previous paragraphs are only examples for the disclosed technique. They should not be used to constrain the scope of the invention. Any person skilled in the art can readily make equivalent modification and changes without departing from the spirit of the invention. For example, the two components of the insertion can be changed into the left-right combination.

Effects of the Invention

Using the design of guide channels inside the insertion element, the twisted pairs can be kept in a parallel and non-twisted state. Therefore, it is easy to control the wire positions of the twisted pairs. In addition to easy assembly, one can further control the distance between different twisted pairs to achieve the desired TT or TR compensation effect. Consequently, the invention can satisfy the CAT-6 standard for fast data transmissions.

The two-piece design for the insertion element can tightly hold the fast communication cable before the twisted pairs and the insertion element are plugged into the plug shell, preventing incorrect connections between the cable and the metal electrodes during the assembly.

What is claimed is:

1. A fast electric connector plug for assembly with a fast communication cable, comprising:

a plug shell, which is a hollow RJ-45 plug and has an opening on at least one end, and eight metal electrodes on its front end, the eight metal electrodes being inserted into the plug shell and in electrical communications with four twisted pairs in the fast communication cable; and an insertion element, which is plugged into the plug shell from the opening thereof, and has a plurality of guide channels for guiding the four twisted pairs in the fast communication cable to connect with the metal electrodes, each guide channel being a long hole for a twisted pair to go through in a parallel and non-twisted way and the guide channels controlling the distances among the wires in the four twisted pairs the guide channels being formed in four directions relative to a central point of the insertion element and one of the guide channels has at least three holes for the wires in the twisted pairs to pass through and the distance between the wires is controlled by their positions in the guide channel with at least three holes.

2. The fast electric connector plug of claim 1, wherein the guide channels which are formed in four directions that are symmetric relative to a central point of the insertion element.

3. The fast electric connector plug of claim 2, wherein the four directions are up, down, left, and right.

4. The fast electric connector plug of claim 3, wherein the third twisted pair and the first twisted pair of the fast communication cable go through the guide channels in the up and down directions.

5. The fast electric connector plug of claim 1, wherein the TT/TR effect can be produced by arranging one wire close to another wire in an adjacent twisted pair.

6. The fast electric connector plug of claim 1, wherein the guide channel opposite to the guide channel with at least three holes also has corresponding at least three holes for wires of the twisted pairs to pass through.

7. The fast electric connector plug of claim 1, wherein the carrier has a plurality of wire slots extending forward near the front end of the plug shell and the wire slots are underneath the eight metal electrodes for supporting different twisted pairs at the same level.

8. The fast electric connector plug of claim 7, wherein the metal electrodes are at the same level.

9. The fast electric connector plug of claim 1, wherein the insertion element further contains a carrier and a cover that couple with each other.

10. The fast electric connector plug of claim 9, wherein a plurality of protruding saws are formed on the surface of the cover that faces the fast communication cable so that the fast communication cable is tightly clinched between the cover and the carrier after they are combined together.

11. The fast electric connector plug of claim 1, wherein the guide channel has a tube structure.

12. The fast electric connector plug of claim 1, wherein the guide channel has a groove structure.

13. The fast electric connector plug of claim 1, wherein the carrier has a left wall and a right wall and the walls are formed with connecting parts for coupling with corresponding connecting parts on the cover.

14. The fast electric connector plug of claim 1, wherein the top surface of the cover has a hook for connection with a hook hole formed on the upper wall of the plug shell.

* * * * *